US007883456B2

(12) United States Patent
Kusumoto et al.

(10) Patent No.: US 7,883,456 B2
(45) Date of Patent: Feb. 8, 2011

(54) CENTRIFUGAL MACHINE HAVING A VIBRATION PREVENTING MECHANISM

(75) Inventors: Shoji Kusumoto, Ibaraki (JP); Shinki Ohtsu, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 717 days.

(21) Appl. No.: 11/848,397

(22) Filed: Aug. 31, 2007

(65) Prior Publication Data

US 2009/0023571 A1 Jan. 22, 2009

(30) Foreign Application Priority Data

Sep. 1, 2006 (JP) ..... P2006-237480

(51) Int. Cl.
*B04B 9/14* (2006.01)
*B04B 13/00* (2006.01)

(52) U.S. Cl. ..... 494/10; 494/82

(58) Field of Classification Search ..... 494/1, 494/7, 10, 11, 13, 14, 16, 20, 31, 33, 82; 210/144, 379

See application file for complete search history.

(56) References Cited

U.S. PATENT DOCUMENTS

| | | | | |
|---|---|---|---|---|
| 3,804,324 | A * | 4/1974 | Sinn et al. | 494/14 |
| 4,079,882 | A * | 3/1978 | Mizuyoshi et al. | 494/60 |
| 4,099,667 | A * | 7/1978 | Uchida | 494/7 |
| 4,193,536 | A * | 3/1980 | Kubota | 494/14 |
| 5,827,168 | A * | 10/1998 | Howell | 494/7 |
| 6,338,708 | B1 * | 1/2002 | Miura et al. | 494/82 |
| 6,866,621 | B1 * | 3/2005 | Muller et al. | 494/7 |
| 6,953,424 | B2 * | 10/2005 | Kusumoto et al. | 494/10 |
| 7,806,820 | B2 * | 10/2010 | Howell | 494/82 |
| 2004/0023778 | A1 * | 2/2004 | Kusumoto et al. | 494/10 |

FOREIGN PATENT DOCUMENTS

| | | | |
|---|---|---|---|
| JP | 02-074840 | | 3/1990 |
| JP | 7-26669 | | 3/1995 |
| JP | 09010631 | A * | 1/1997 |
| JP | 9-239293 | | 9/1997 |
| JP | 11333326 | A * | 12/1999 |
| JP | 2004-64945 | | 2/2004 |
| JP | 2005-111402 | | 4/2005 |
| JP | 2006-7093 | | 1/2006 |

* cited by examiner

*Primary Examiner*—Charles E Cooley
(74) *Attorney, Agent, or Firm*—McDermott Will & Emery LLP

(57) ABSTRACT

A centrifugal machine includes a vibration preventive mechanism part containing a support member and a damping portion disposed in the support member so as to be connectable or contactable to the drive device. The damping portion includes a magnet member and a friction member disposed on the support member and, owing to the magnetic force of the magnet member, the friction member is contacted with a first arm member. The magnet member can be magnetized by an electromagnetic coil and, owing to the magnetic force of the magnet member, the friction member can be contacted with the first arm member. On receiving a vibration change from a drive device, the vibration preventive mechanism part can dampen the vibration change using the damping portion.

15 Claims, 4 Drawing Sheets

CENTRIFUGAL MACHINE HAVING A VIBRATION PREVENTING MECHANISM

CROSS-REFERENCE TO RELATED APPLICATIONS

This application is based upon and claims the benefit of priority from Japanese Patent Application No. 2006-237480, filed Sep. 1, 2006, the entire contents of which are incorporated herein by reference.

BACKGROUND OF THE INVENTION

A centrifugal machine is an apparatus in which a specimen to be centrifuged is inserted into a rotor through a tube or a bottle, the rotor is coupled to the rotation shaft of a drive device made of a motor, and the rotor is rotated at a high speed to thereby centrifuge and refine the specimen. The rotation speed of the centrifugal machine varies depending on the use of the specimen to be centrifuged and refined; and, according to the uses of the centrifugal machines, generally, there are supplied various types of centrifugal machines the rotation speeds of which range from a low rotation speed of several thousands of rpm to a high rotation speed of 150,000 rpm or so. The types of rotors to be driven by the drive device also vary depending on the uses thereof; and, for example, there are known an angle rotor in which a tube hole is fixed, and a swing rotor in which a bucket with a tube loaded therein is rotated to thereby oscillate a rotor from a vertical state to a horizontal state. The rotors of these types can be mounted and removed as well as can be replaced through the rotation shafts of the drive devices that are used to rotate their associated rotors.

In these conventional centrifugal machines, as disclosed in the below-mentioned patent reference 1, the vibration of the drive device is dampened by supporting the drive device within a box member (a frame) through vibration preventive rubber which is referred to as a damper. Also, the vibration of the rotor, which is generated due to the imbalance of the rotor itself and due to the imbalance of the capacity, mass and the like of a specimen to be loaded into the rotor, is also transmitted to the drive device not only through the rotor but also through the rotation shaft, and is dampened by vibration preventive rubber (a damper) which supports the drive device.

The vibration involved with the centrifugal machine raises the following two major problems. The first is a self-excited vibration problem. As disclosed in the below-mentioned patent reference 2, owing to the imbalance of a specimen to be inserted into the rotor, or owing to a backlash between the rotation shaft of the rotor and a support cylindrical shaft, in the high speed rotation of the rotor, there can be generated a self-excited vibration having a low frequency component different from the rotation component of the rotor. This is referred to as self-excited vibration which is generated when the damping amount (internal damping amount) of the rotating structure member is larger than the damping amount (external damping amount) of the support-side vibration damping mechanism such as vibration preventive rubber. Also, the second problem is that, as disclosed in the below-mentioned patent reference 3, the damping characteristic (damping constant) of the vibration preventive rubber has temperature dependence. In other words, the temperature of the vibration preventive rubber can vary according to the temperature of the rotor chamber or according to the operating condition of the rotor (for example, it can vary in the range of 2° C.~40° C.), and the damping amount of the vibration is greatly influenced by the temperature variation of the vibration preventive rubber.

To cope with these vibration problems, in Japanese Patent Publication Hei-7-26669 and Japanese Patent Publication 2005-111402, there is disclosed a technology which detects the vibration caused by the imbalance of the rotor. Also, in the Japanese Patent Publication 2006-7093, there is disclosed a technology in which there is provided an imbalance detect sensor and, when the output signal of the imbalance detect sensor provides a value equal to or higher than a given value, the drive device is caused to stop. Further, in the Japanese Patent Publication Hei-9-239293, there is disclosed a method for mounting a rotor onto a drive shaft in order to prevent the occurrence of the self-excited vibration; and, in Japanese Patent Publication 2004-64945, there is disclosed a technology in which, in order to compensate the temperature dependence of the vibration preventive rubber, a Peltiert element is used to control the environmental temperature of the vibration preventive rubber, thereby holding the damping characteristic of the vibration preventive rubber at the optimum value.

In the conventional centrifugal machines, the damping of the vibration generated in the vibratory system thereof depends almost on the provision of the vibration preventive rubber and, in order to increase the damping amount, the number of provision of the vibration preventive rubber is increased. However, to increase the number of provision of the vibration preventive rubber does not increase the damping amount (damping constant) but increases the spring reaction force that is given by the vibration preventive rubber. When the spring reaction force becomes large, the vibration to be transmitted from the drive device through the vibration preventive rubber (damper) to the box member increases. As a result of this, the box member becomes easy to vibrate, which makes it difficult to secure a sufficient damping amount. Further, as described above, since the damping amount of the vibration preventive rubber depends on the temperature thereof, it is necessary to compensate a reduction in the damping amount caused by the temperature dependence.

SUMMARY OF THE INVENTION

One of objects of the present invention is to provide a centrifugal machine including a vibration preventive mechanism which can increase the damping amount of the vibration generated in the vibratory system thereof.

Another of objects of the present invention is to provide a centrifugal machine including a vibration preventive mechanism which can restrict the temperature dependence of the vibration damping amount of the vibration preventive rubber.

According to an aspect of the present invention there is provided a centrifugal machine comprising a box member; a drive device mounted within the box member and having a rotation shaft; a rotor connected to the rotation shaft of the drive device for holding a specimen to be centrifuged; and, a damper for mounting the drive device into the box member, wherein the centrifugal machine further includes a vibration preventive mechanism part, the vibration preventive mechanism part containing a support member to be supported by the box member and a damping portion disposed in the support member so as to be connectable or contactable to the drive device, and also wherein, on receiving a vibration change from the drive device, the vibration preventive mechanism part can dampen the vibration change using the damping portion.

BRIEF DESCRIPTION OF THE DRAWINGS

The present invention may be more readily described with reference to the accompanying drawings.

DETAILED DESCRIPTION OF THE PREFERRED EMBODIMENTS

Now, description will be given below in detail of an embodiment of a centrifugal machine according to the invention with reference to the accompanying drawings. In all figures, parts having the same function are given the same designations and the repeated description thereof will be omitted.

Figure 1:
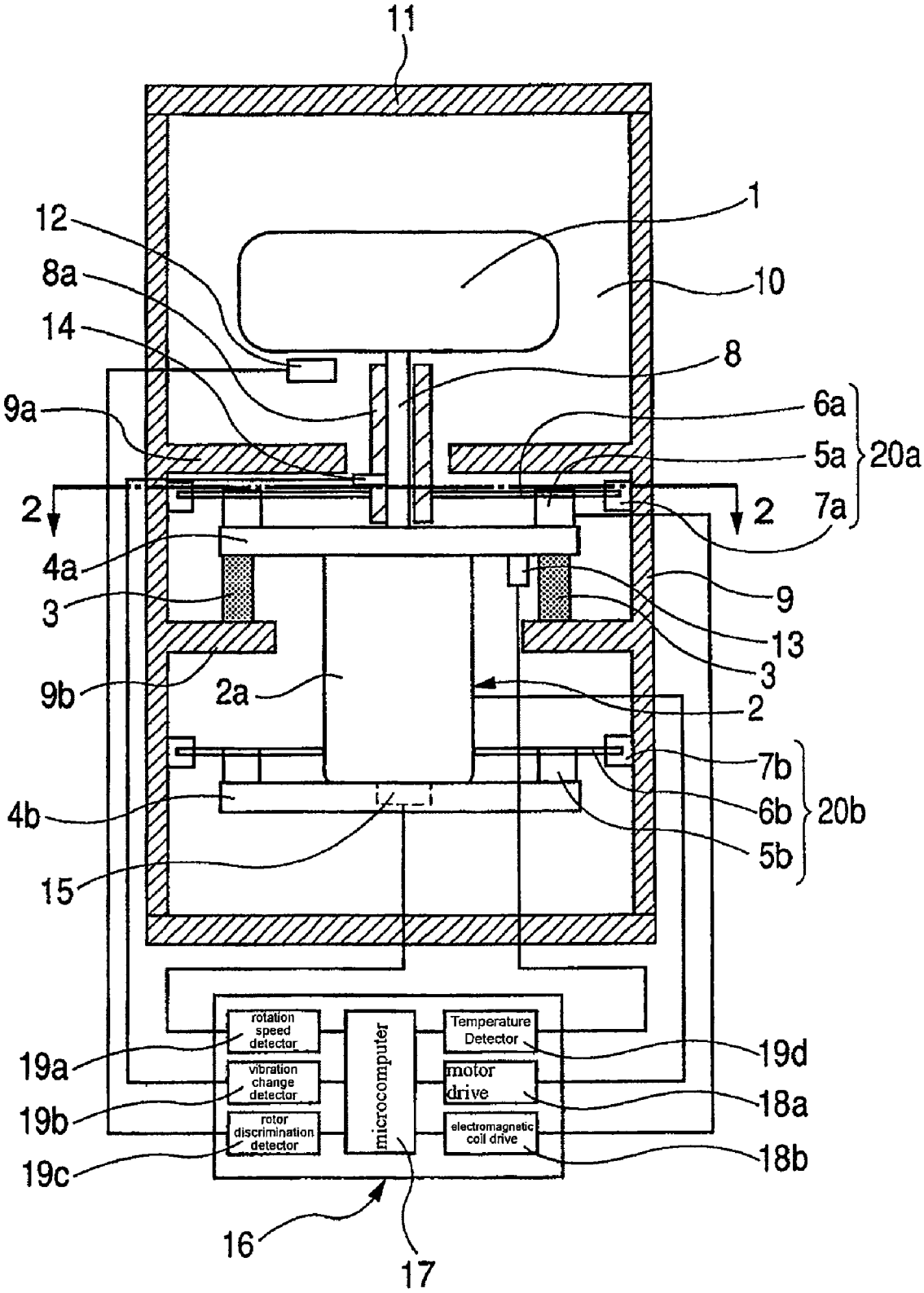
FIG. 1 is a structure view of a centrifugal machine according to an embodiment of the invention.
Figure 2:
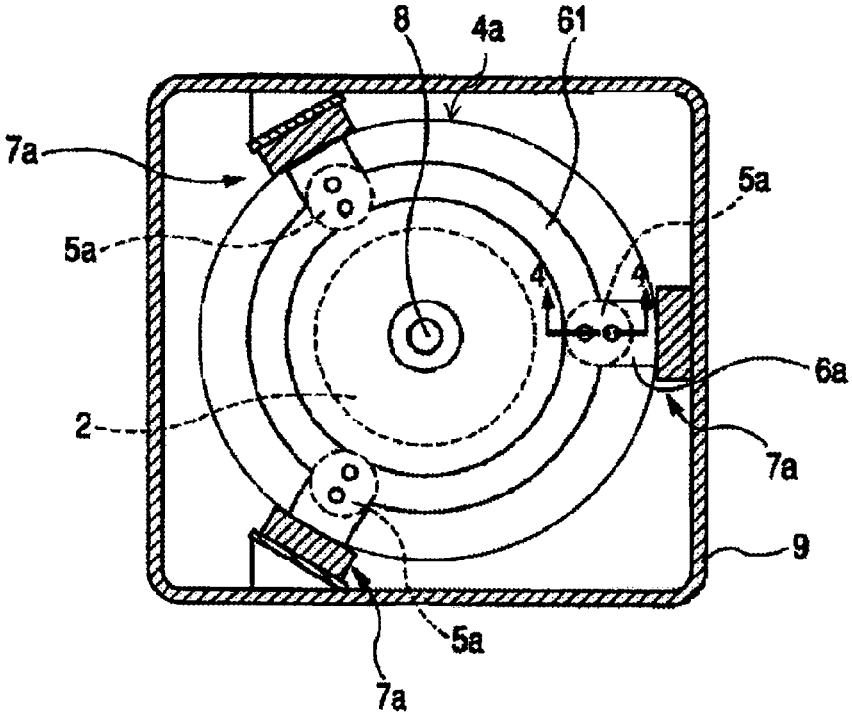
FIG. 2 is a section view of the centrifugal machine, taken along the 2-2 line shown in FIG. 1.
Figure 3:
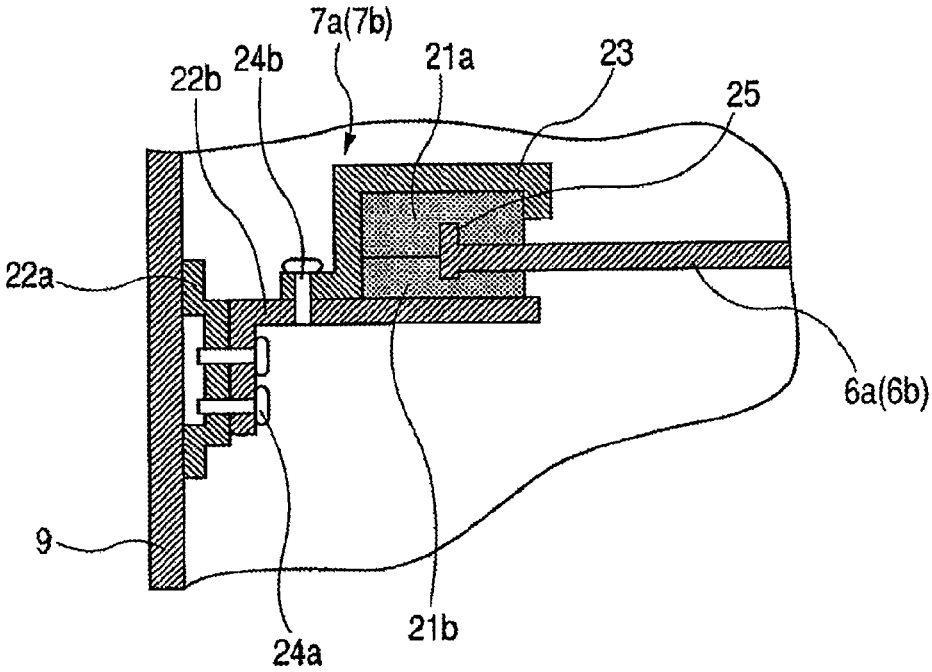
FIG. 3 is a structure view of a support portion of a vibration preventive mechanism provided in the centrifugal machine shown in FIG. 1.
Figure 4:
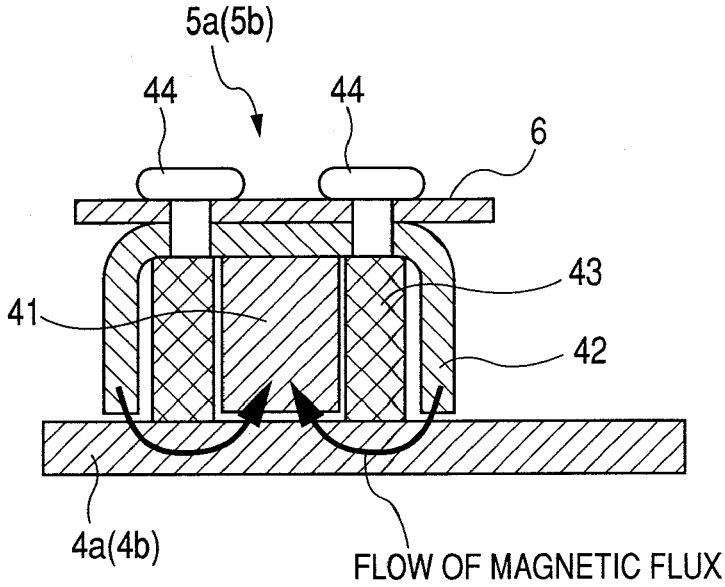
FIG. 4 is a section view of a friction damping portion of the vibration preventive mechanism of the centrifugal machine shown in FIG. 1, taken along the 4-4 line of FIG. 2.
Figure 5:
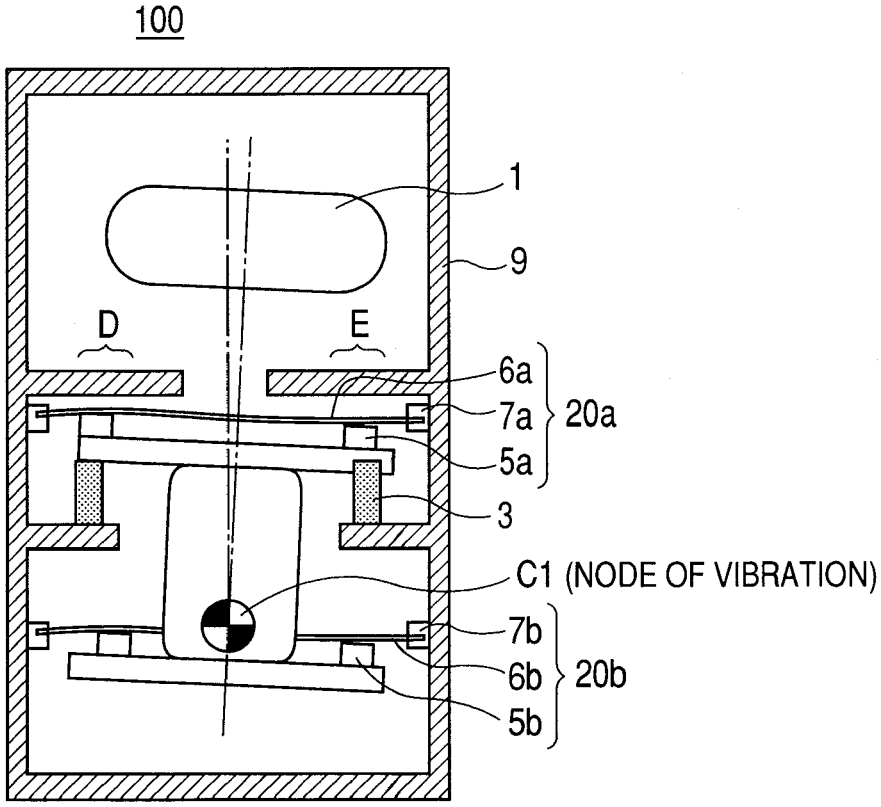
FIG. 5 is a section view of the centrifugal machine shown in FIG. 1, showing a first vibration mode thereof.
Figure 6:
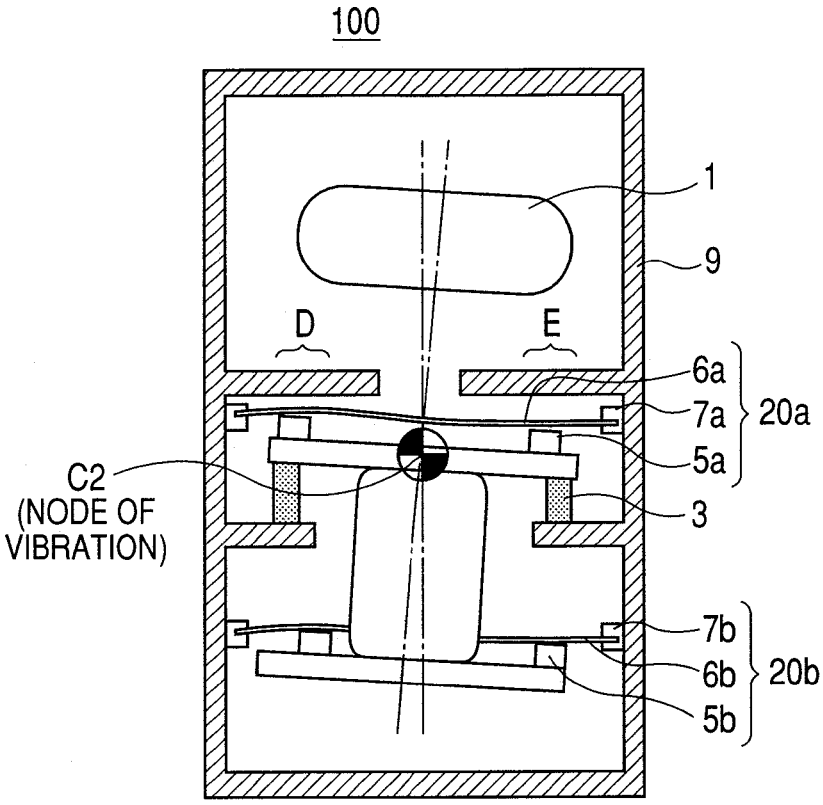
FIG. 6 is a section view of the centrifugal machine shown in FIG. 1, showing a second vibration mode thereof.
Figure 7:
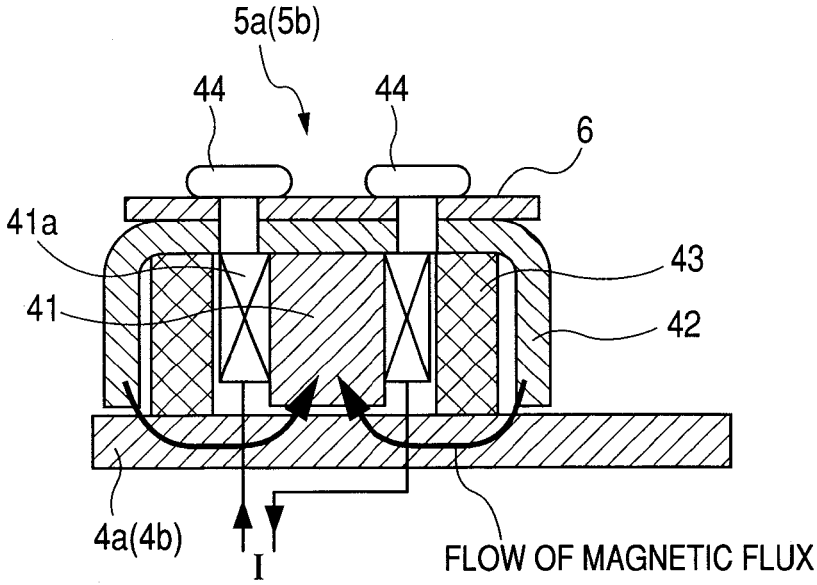
FIG. 7 is a structure view of another embodiment of the friction damping portion of the vibration preventive mechanism of the centrifugal machine shown in FIG. 1.

FIG. 1 is a structure view of a centrifugal machine according to an embodiment of the invention. FIG. 2 is a section view of the centrifugal machine, taken along the 2-2 line shown in FIG. 1. FIG. 3 is a structure view of a support portion of a vibration preventive mechanism employed in the centrifugal machine shown in FIG. 1. FIG. 4 is a section view of a friction damping portion included in the vibration preventive mechanism of the centrifugal machine shown in FIG. 1, taken along the 4-4 line of FIG. 2. FIGS. 5 and 6 are respectively section views of the centrifugal machine shown in FIG. 1, showing the vibration modes thereof. FIG. 7 is a structure view of another embodiment of the friction damping portion of the vibration preventive mechanism of the centrifugal machine shown in FIG. 1.

Firstly, description will be given below of the whole structure of a centrifugal machine according to an embodiment of the invention with reference to FIG. 1.

A centrifugal machine 100, when viewed from above, has a substantially square section. The centrifugal machine 100 includes a box member (a frame) 9 (see FIG. 3) made of a steel plate member. In the interior of the box member 9, there are disposed a rotor 1 made of a titanium alloy, an aluminum alloy or the like for holding a specimen vessel (not shown) such as a tube for centrifugation, a drive device 2 made of a motor for applying a drive force of high speed rotation to the rotor 1 through a rotation shaft 8, and a rotor chamber 10 defined by a first connecting member 9*a* of the box member 9 for storing the rotor 1 therein. And, on the upper opening portion (opening/closing portion) of the rotor chamber 10 formed within the box member 9, there is mounted a door 11 in such a manner that it can be opened and closed with respect to the box member 9.

Adjacently to the bottom surface of the rotor 1, there is mounted a rotor discrimination sensor 12 which is used to discriminate an identifier (a discrimination code) (not shown) representing the type of the rotor 1. The rotor discrimination sensor 12 is made of, for example, a magnetic sensor; and, a signal detected by the magnetic sensor 12 is demodulated by a rotor discrimination detect portion 19*c* as a discrimination signal for discriminating the type of the rotor, and the discrimination signal is then transmitted to a control device 16 (which will be discussed later).

The drive device 2 includes an upper arm member 4*a* and a lower arm member 4*b* respectively fixed to a drive device main body 2*a* for storing a motor therein, and further includes a shaft case 8*a* for covering a rotation shaft 8. On the bottom portion of the drive device 2, there is mounted a rotation speed sensor 15 which is used to detect the rotation speed of the drive device main body 2*a*. And, on the rotation shaft 8 of the drive device 2, there is mounted a vibration change sensor (a vibration sensor) 14 which is used to detect the vibration of the rotation shaft 8.

The upper arm member 4*a* of the drive device 2 has a circular flat shape and is mounted on the second connecting member 9*b* of the box member 9 through more than one vibration preventive rubber (damper) 3 to secure an external damping amount between the drive device 2 and box member 9. Although not limited specifically, according to the present embodiment, the vibration preventive rubber 3 is disposed along the outer periphery of the upper arm member 4*a* at three positions which are spaced 120 degrees apart from each other. In the vicinity of the vibration preventive rubber 3, there is disposed a temperature sensor 13. The temperature sensor 13 detects the ambient temperature of the vibration preventive rubber 3; and, the detect signal of the temperature sensor 13 is demodulated as a temperature signal by a temperature detect portion 19*d* and the temperature signal is transmitted to a control device 16 (which will be discussed later).

A first vibration preventive mechanism part 20*a* according to the invention, as shown in FIGS. 1 and 2, is composed of a combination which consists of a support member (which is hereinafter referred to as a "beam portion") 6*a*, more than one first friction damping portion 5*a* and a support portion 7*a*. The beam portion 6*a*, as will be discussed later, is supported by the box member 9 through elastic members 21*a* and 21*b* provided in the support portion 7*a* and is disposed so as to press the friction damping portions 5*a* against the arm member 4*a*. The beam portion 6*a* is made of such an elastic member that, when a vertical-direction load crossing the plane surface of the beam portion 6*a* is applied thereto, can be flexed, but will not be expanded or deformed (flexed) when it receives a horizontal-direction load. The beam portion 6*a* can be made of, for example, a thin steel plate.

The support portion 7*a* which supports the beam portion 6*a* on the box member 9, as shown in FIG. 2, supports the circumferential portion of the beam portion 6*a* at three positions thereof. The support portion 7*a*, as shown in FIG. 3, includes a first base 22*a* fixed to the box member 9, a second base 22*b* fixed to the first base 22*a* with screws 24*a*, and upper and lower elastic members 21*a* and 21*b* respectively held by a hold portion 23 which is mounted on the second base 22*b* with a screw 24*b*. The beam portion 6*a* is enclosed by a pair of elastic members 21*a* and 21*b* and is supported in the box member 9. In this case, in the end portion of the beam portion 6*a*, there is formed a stopper portion 25 which is used to prevent the beam portion 6*a* against removal. Here, the beam portion 6*a* functions as an elastic member which does not restrict the drive device 2 in the vertical direction nor can be expanded or deformed in the horizontal direction.

The friction damping portions 5*a*, as shown in FIG. 2, are formed at the three positions of the circumferential portion of the beam portion 6*a* in such a manner that they correspond to the support portions 7*a* respectively. As shown in FIG. 4, the friction damping portion 5*a* includes a cylindrical-shaped yoke 42 fixed to the beam portion 6*a* with screws 44, a magnet (for example, a permanent magnet) 41 fixed to the yoke 42, and a cylindrical-shaped friction member 43 held by and between the arm member 4*a* and yoke 42. In this case, the friction member 43 is made of, for example, plastic material. The friction member 43 is pressed against the arm member 4*a* due to the magnetic force of the magnet 41, while a load (a compressive stress) to be applied to the friction member 43 can be adjusted due to the magnetic force of the magnet 41. By the way, the magnet 41 may also be made of an electromagnet and, as shown in FIG. 7, when an electromagnetic force to be generated by the magnet 41 is generated by the electromagnetic coil 41*a*, the magnetic force can be changed using a current to be fed to the electromagnetic coil 41. That is, a damping force can be made variable.

A second vibration preventive mechanism part 20*b* according to the invention is composed of a combination which includes a beam portion 6*b*, two or more second friction damping portions 5*b* and a support portion 7*b*. The beam portion 6*b*, two or more second friction damping portions 5*b* and support portion 7*b* have quite the same functions as the above-mentioned beam portion 6*a*, two or more first friction damping portions 5*a* and support portion 7*a* of the first vibration preventive mechanism part 20*a* and thus the description thereof is omitted here.

A control device (a controller) 16 includes a microcomputer 17, a motor drive portion 18*a*, an electromagnetic coil drive portion 18*b*, a rotation speed detect portion 19*a* for detecting the output of the rotation speed sensor 15 of the drive device 2, a vibration change detect portion 19*b* for detecting the output of the vibration change sensor 14, a rotor discrimination detect portion 19*c* which is used to demodulate a signal detected by the magnetic sensor 12 as a discrimination signal for discriminating the type of the rotor, and a temperature detect portion 19*d* for demodulating an ambient temperature detected by the temperature sensor 13 as a temperature signal. The control device 16 is used to input and control the operation conditions of the drive device 2 such as the rotation speed, operation hours (centrifugation hours), acceleration gradient and deceleration gradient. Further, according to the invention, the control device 16 is structured such that, based on the input signals input to the microcomputer 17 that respectively express the rotation speed of the drive device 2, the ambient temperature of the vibration preventive rubber 3 or the vibration change of the rotation shaft 8, the control device 16 can control the exciting current I of the electromagnetic coil 41*a* (see FIG. 7) of the friction damping portion 5*a* incorporated into the first vibration preventive mechanism part 20*a*.

In the above-mentioned structure of the invention, vibrations to be generated during the high speed rotation of the centrifugal machine 100 can be dampened in the following manner.

When, the vibration mode is a mode in which, for example, as shown in FIG. 5, the drive device 2 vibrates in a conical manner, since the friction damping portion 5 (including 5*a* and 5*b*) is attracted by the arm portion 4 (including 4*a* and 4*b*), with the vibration of the drive device 2, the friction damping portion 5 is moved in the vertical direction in such a manner that the left area D thereof is pushed upward and the right area E thereof is pulled downward. As a result of this, a bending moment is applied to the support member (beam portion) 6 (including 6*a* and 6*b*). Especially, when the node of the vibration is present in the lower portion C1 of the drive device 2, a larger bending moment is applied to the beam portion 6*a* of the first vibration preventive mechanism part 20*a* than the beam portion 6*b*. However, according to the invention, since the beam portion 6, as described above, is made of an elastic member or a thin steel plate, the beam portion 6 is flexed in the vertical direction, with the result that the bending rigidity of the beam portion 6 will not provide any spring reaction force with respect to the attracting force of the friction damping portion 5. That is, the vibration can be dampened without having an ill influence on the spring characteristic of the vibratory system of the drive device 2. On the other hand, since the beam portion 6, as shown in FIG. 3, is supported in the box body 9 by the support portion 7 (including 7*a* and 7*b*) which is sandwiched by the elastic members 21*a* and 21*b* and is held by the hold portion 23, not only the vertical-direction movement of the beam portion 6 is not restricted but also the beam portion 6 cooperates together with the friction damping portion 5 in preventing the horizontal-direction sliding vibration of the arm member 4 from being transmitted to the box member 9.

According to the vibration preventive mechanism part 20 (including 20*a* and 20*b*) of the invention, the friction damping portion 5, in consequence, moves in the transverse direction (in the horizontal direction) on the surface of the arm member 4 relatively to the arm member 4 while it is pulled up or pulled down due to the vibration of the drive device 2, so that the friction damping portion 5 generates a damping force due to the friction caused by the friction member 43. Here, the intensity of the damping force is decided according to the intensity of the magnetic force of the magnet 41 and a coefficient of friction between the friction member 43 and arm member 4.

By the way, the friction damping portion 5, as shown in FIG. 2, may be provided three or more on a single horizontal plane and they may be then connected together using a beam connecting portion (a support member) (61).

Also, in the vibration mode of the centrifugal machine, as shown in FIG. 6, in some cases, the node of the vibration can be present in the upper portion C2 of the drive device 2; and, therefore, when the second vibration preventive mechanism part 20*b* is provided, the vibration can be dampened more perfectly. In this case, as shown in FIG. 5, when the vibration node is present in the lower portion C1 of the drive device 2, the upper portion of the drive device 2 is vibrated greatly, with the result that the friction damping portion 5*a* of the first vibration preventive mechanism part 20*a* works effectively. On the other hand, as shown in FIG. 6, when the vibration node is present in the upper portion C2, the lower portion of the drive device 2 is vibrated greatly, with the result that the friction damping portion 5*b* of the second vibration preventive mechanism part 20*b* works effectively. Therefore, it is more effective and more desirable to dispose the friction damping portions 5*a* and 5*b* in the two upper and lower end portions of the drive device 2.

Further, as shown in FIG. 7, in the case where the magnetic force of the friction damping portion 5 is to be made variable using a current I to be fed to the electromagnetic coil 41*a*, the intensity of the vibration is detected in the shaft detect portion 19*b* using the vibration change sensor (vibration sensor) 14 and the electromagnetic coil drive portion 18*b* is controlled by the microcomputer 17. In this case, the damping force can be controlled in the following manner: that is, when the vibration is large, by increasing the current I, the damping force can be increased; and, when the vibration is small, by decreasing the current I, the damping force can be decreased. When the vibration mode is previously known, the damping force of the friction damping portion 5 of the vibration preventive mechanism part 20 can be changed according to the vibration mode.

Also, when the magnetic force of the friction damping portion 5 is to be made variable by the current I to be fed to the electromagnetic coil 41*a*, as a control signal, the temperature of the vibration preventive rubber 3 of the damper or the ambient temperature thereof is detected by the temperature sensor 13 (see FIG. 1) and, based on the detect signal of the temperature detect portion 19*d*, the current I to be fed to the electromagnetic coil 41*a* is controlled by the microcomputer 17, whereby the damping force can be adjusted in correspondence to the temperature dependence of the damping characteristic of the vibration preventive rubber 3. For example, since, when the temperature of the vibration preventive rubber 3 rises, the damping force reduces, by adjusting the current I to rise, the magnetic force of the magnet (core) 41 can be increased and thus the damping force can be increased. Similarly, using the rotor discrimination sensor 12, there may be detected a vibration mode corresponding to the kind of the mass or the like of the rotor 1, and the current I to be fed to the electromagnetic coil 41*a* may be controlled so that there can be provided such damping force as corresponds to the vibration mode. Further, the rotation speed of the rotor 1 may be detected using the rotation speed sensor 15 and the current I to be fed to the electromagnetic coil 41*a* may be controlled according to the rotation speed of the rotor 1 to thereby be able to vary the electromagnetic force. In this manner, since the use of the magnet 41, differently from the use of a permanent magnet, makes it possible to adjust the magnetic force, the life of the friction member 43 can be extended and also the centrifugal machine can be structured such that an unnecessary damping force cannot be applied to the vibration system of the centrifugal machine.

Although the invention made by the present inventors has been described heretofore specifically based on the embodiment thereof, the invention is not limited to the embodiment but other various changes are also possible without departing from the scope of the subject matter of the invention.

What is claimed is:

1. A centrifugal machine comprising:

a box member;

a drive device mounted within the box member and having a rotation shaft;

a rotor connected to the rotation shaft of the drive device for holding a specimen to be centrifuged;

a vibration preventive mechanism part including a support member made of a thin plate, at least a part of the support member being connected to the box member through an elastic member; and a damping portion fixed to the support member and extending toward a first arm member on which the drive device is disposed, wherein the support member can be flexed up and down in a direction of the rotation shaft of the drive device.

2. The centrifugal machine according to claim 1, wherein the damping portion is contacted with the first arm member through a friction member.

3. The centrifugal machine according to claim 2, wherein the damping portion dampens the vibration change due to friction.

4. The centrifugal machine according to claim 1, wherein the damping portion does not have a spring reaction force with respect to the drive device.

5. The centrifugal machine according to claim 1, wherein the damping portion is smaller in a spring reaction force than the support member.

6. The centrifugal machine according to claim 1, wherein the damping portion comprises a magnet member and a friction member disposed on the support member and, owing to the magnetic force of the magnet member, the friction member is contacted with the first arm member.

7. The centrifugal machine according to claim 6, wherein the magnet member can be magnetized by an electromagnetic coil and, owing to the magnetic force of the magnet member, the friction member can be contacted with the first arm member.

8. The centrifugal machine according to claim 7, further comprising a control device for controlling a current to be fed to the electromagnetic coil, wherein the control device controls the current based on a detected signal indicative of the rotation speed of the rotor.

9. The centrifugal machine according to claim 8, wherein the control device controls the current to be fed to the electromagnetic coil based on a detected signal indicative of a vibration of the rotor.

10. The centrifugal machine according to claim 8, wherein the control device controls the current to be fed to the electromagnetic coil based on a detected signal indicative of a kind of the rotor to be driven by the drive device, thereby adjusting the electromagnetic force of the electromagnetic coil.

11. The centrifugal machine according to claim 8, wherein the control device controls the current to be fed to the electromagnetic coil based on a detected signal indicative of a temperature of the damping portion or the ambient temperature thereof, thereby adjusting the electromagnetic force of the electromagnetic coil.

12. The centrifugal machine according to claim 1, wherein the support member comprises a plurality of thin plate pieces spaced apart from each other and an annular member made of a thin plate and connecting the pieces.

13. A centrifugal machine comprising:

a frame;

a drive device disposed between a first arm member and a second arm member;

a rotor connected to a rotation shaft of the drive device;

a first support member and a second support member, each of which is connected to the frame through an elastic member;

a first damping portion having a first friction member disposed between the first support member and the first arm member; and a second damping portion having a second friction member disposed between the second support member and the second arm member.

14. The centrifugal machine according to claim 13, wherein one of the first and the second arm members is supported on the frame through a second elastic member.

15. The centrifugal machine according to claim 13, wherein each of the first support member and the second support member comprises a plurality of thin plate pieces spaced apart from each other and an annular member made of a thin plate and connecting the pieces.

* * * * *